US009761197B2

(12) United States Patent
Inomoto et al.

(10) Patent No.: US 9,761,197 B2
(45) Date of Patent: Sep. 12, 2017

(54) COMMUNICATION DEVICE

(71) Applicant: FUJITSU COMPONENT LIMITED, Tokyo (JP)

(72) Inventors: Yutaka Inomoto, Tokyo (JP); Ryohei Okada, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/835,856

(22) Filed: Aug. 26, 2015

(65) Prior Publication Data

US 2016/0125834 A1 May 5, 2016

(30) Foreign Application Priority Data

Oct. 30, 2014 (JP) ..... 2014-221251

(51) Int. Cl.
*G09G 5/00* (2006.01)

(52) U.S. Cl.
CPC ..... *G09G 5/006* (2013.01); *G09G 2370/042* (2013.01); *G09G 2370/24* (2013.01)

(58) Field of Classification Search
None
See application file for complete search history.

(56) References Cited

U.S. PATENT DOCUMENTS

2004/0218627 A1 11/2004 Kobayashi
2009/0285138 A1 11/2009 Thomas et al.
2010/0103272 A1* 4/2010 Yagi ..... G09G 5/006 348/192
2010/0132004 A1 5/2010 Ota et al.
2011/0141007 A1* 6/2011 Yamamizu ..... G03G 15/5004 345/156
2011/0311195 A1 12/2011 Ikeda et al.
2012/0249563 A1* 10/2012 Wyatt ..... G09G 5/36 345/522

(Continued)

FOREIGN PATENT DOCUMENTS

JP 2002-162956 6/2002
JP 2004-350266 12/2004

(Continued)

OTHER PUBLICATIONS

Patent Abstracts of Japan, Publication No. 2011-81571, published Apr. 21, 2011.

(Continued)

*Primary Examiner* — Ke Xiao
*Assistant Examiner* — Jed-Justin Imperial
(74) *Attorney, Agent, or Firm* — Staas & Halsey LLP

(57) ABSTRACT

A communication device includes: an inputter that inputs a USB (Universal Serial Bus) signal from an input device; an acquirer that acquires an EDID (Extended Display Identification Data) signal from a monitor; an instructor that gives an instruction to output the EDID signal to another communication device; a switch that selectively switches a first route for outputting the acquired EDID signal to the another communication device and a second route for outputting the inputted USB signal to the another communication device; and a controller that controls the switch so as to switch from the second route to the first route in accordance with the instruction from the instructor.

10 Claims, 12 Drawing Sheets

(56) References Cited

U.S. PATENT DOCUMENTS

| | | | | |
|---|---|---|---|---|
| 2013/0154946 | A1* | 6/2013 | Sakuramata | G06F 3/0227<br>345/172 |
| 2015/0325201 | A1 | 11/2015 | Toba et al. | |

FOREIGN PATENT DOCUMENTS

| | | | |
|---|---|---|---|
| JP | 2011-81571 | | 4/2011 |
| WO | 2014/109322 | A1 | 7/2014 |

OTHER PUBLICATIONS

Patent Abstracts of Japan, Publication No. 2004-350266, published Dec. 9, 2004.
Patent Abstracts of Japan, Publication No. 2002-162956, published Jun. 7, 2002.
Extended European Search Report dated Mar. 4, 2016 in corresponding European Patent Application No. 15182749.0.

* cited by examiner

FIG. 2

INTERNAL CONNECTION OF LAN CABLE

1. VIDEO SIGNAL R+
2. VIDEO SIGNAL R-
3. SERIAL SIGNAL+
4. VIDEO SIGNAL G+
5. VIDEO SIGNAL G-
6. SERIAL SIGNAL-
7. VIDEO SIGNAL B+
8. VIDEO SIGNAL B-

COMMUNICATION DEVICE

CROSS-REFERENCE TO RELATED APPLICATION

This application is based upon and claims the benefit of priority of the prior Japanese Patent Application No. 2014-221251 filed on Oct. 30, 2014, the entire contents of which are incorporated herein by reference.

FIELD

A certain aspect of the embodiments is related to a communication device that is placed between a computer and a console (e.g. a keyboard, a mouse, a monitor and so on).

BACKGROUND

Conventionally, there has been known a communication device which can install a console (e.g. a USB (Universal Serial Bus) keyboard, a USB mouse, a monitor and so on) at a position away from a computer (see Patent Document 1: Japanese Laid-open Patent Publication No. 2011-81571). The communication device includes a local unit and a remote unit. The computer is connected to the local unit. The USB keyboard, the USB mouse, the other USB device, the monitor and so on are connected to the remote unit. The local unit and the remote unit are connected via a LAN (Local Area Network) cable or an optical cable, for example, and are placed away from each other. Thereby, a user who is away from an installation place of the computer can operate the computer by using the console and confirm a video outputted from the computer.

Then, the remote unit of the Patent Document 1 aggregates a USB signal from a keyboard and a mouse and an EDID signal indicative of a frequency or a resolution that a monitor can support, as a single signal, and transmits the single signal to the local unit.

SUMMARY

According to a first aspect of the present invention, there is provided a communication device including: an inputter that inputs a USB (Universal Serial Bus) signal from an input device; an acquirer that acquires an EDID (Extended Display Identification Data) signal from a monitor; an instructor that gives an instruction to output the EDID signal to another communication device; a switch that selectively switches a first route for outputting the acquired EDID signal to the another communication device and a second route for outputting the inputted USB signal to the another communication device; and a controller that controls the switch so as to switch from the second route to the first route in accordance with the instruction from the instructor.

According to a second aspect of the present invention, there is provided a communication device including: a detector that detects disconnection of USB (Universal Serial Bus) communication with another communication device; a switch that selectively switches a first route for inputting an EDID (Extended Display Identification Data) signal from the another communication device and a second route for inputting a USB signal from the another communication device; and a controller that controls the switch so as to switch from the second route to the first route when the detector detects the disconnection of the USB communication with the another communication device.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 2 is a diagram indicative of information on internal connection of a LAN cable;

DESCRIPTION OF EMBODIMENTS

The above-mentioned remote unit of the Patent Document 1 superposes the EDID signal on the USB signal. Therefore, when a timing that superposes the EDID signal on the USB signal is deviated, the remote unit cannot transmit the EDID signal to the local unit. Moreover, when a noise is mixed on the superposed signal, the local unit may not retrieve the EDID signal from the superposed signal.

A description will now be given of a present embodiment with reference to the drawings.

Figure 1:
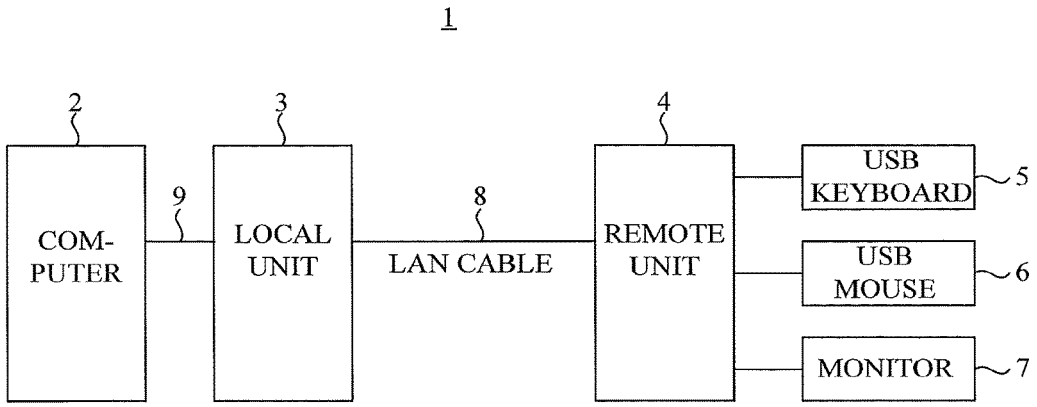
FIG. 1 is a diagram illustrating the configuration of a communication system including a communication device according to a present embodiment.

FIG. 1 is a diagram illustrating the configuration of a communication system including a communication device according to a present embodiment.

A communication system 1 includes a computer 2, a local unit 3 as a communication device, a remote unit 4 as a communication device, a USB (Universal Serial Bus) keyboard 5, a USB mouse 6 and a monitor 7. The local unit 3 and the remote unit 4 are called extenders, and are used for extending a communication distance between the computer 2, and the USB keyboard 5, the USB mouse 6 and the monitor 7. The local unit 3 is connected to the computer 2 via an exclusive cable 9 which makes a video signal and a serial signal pass. The local unit 3 is connected to the remote unit 4 via a LAN (Local Area Network) cable (e.g. a Category 5 cable) 8. The remote unit 4 is connected to the USB keyboard 5, the USB mouse 6 and the monitor 7. A USB device, such as a printer or a touch panel, may be connected to the remote unit 4.

The video signal outputted from the computer 2 is displayed on the monitor 7 via the local unit 3 and the remote unit 4. The serial signal (i.e., USB signal) outputted from the USB keyboard 5 and the USB mouse 6 is inputted to the computer 2 via the local unit 3 and the remote unit 4.

FIG. 2 is a diagram indicative of information on internal connection of the LAN cable.

The LAN cable 8 includes four pairs of signal lines (i.e., eight signal lines in total). A first signal line and a second signal line are used for the transmission of the video signal of a red (R). A fourth signal line and a fifth signal line are used for the transmission of the video signal of a green (G). A seventh signal line and an eighth signal line are used for the transmission of the video signal of a blue (B). A third signal line and a sixth signal line are used for the transmission of the serial signal. Here, since each of the local unit 3 and the remote unit 4 converts the video signal and the serial signal into a differential signal and transmits the differential signal, a pair of signal lines (i.e., two signal lines in total) is assigned to each signal.

Since three pairs of signal lines out of the four pairs of signal lines are assigned to the video signal of RGB, two types of serial signals which are the USB signal outputted from the USB keyboard 5 and the USB mouse 6 and an EDID (Extended Display Identification Data) signal of the monitor 7 are transmitted with a pair of remaining signal lines. Here, the EDID signal is controllable by microcomputers included in the local unit 3 and the remote unit 4, and includes a frequency and a resolution that the monitor 7 can support. The frequency includes horizontal and vertical scanning frequencies and a clock frequency of the video signal. The resolution includes dot values in horizontal and vertical directions which the monitor 7 can support. Moreover, the EDID signal includes attribute information of the monitor 7, such as a manufacturer name (Vendor ID) and a type (Product ID).

Figure 3:
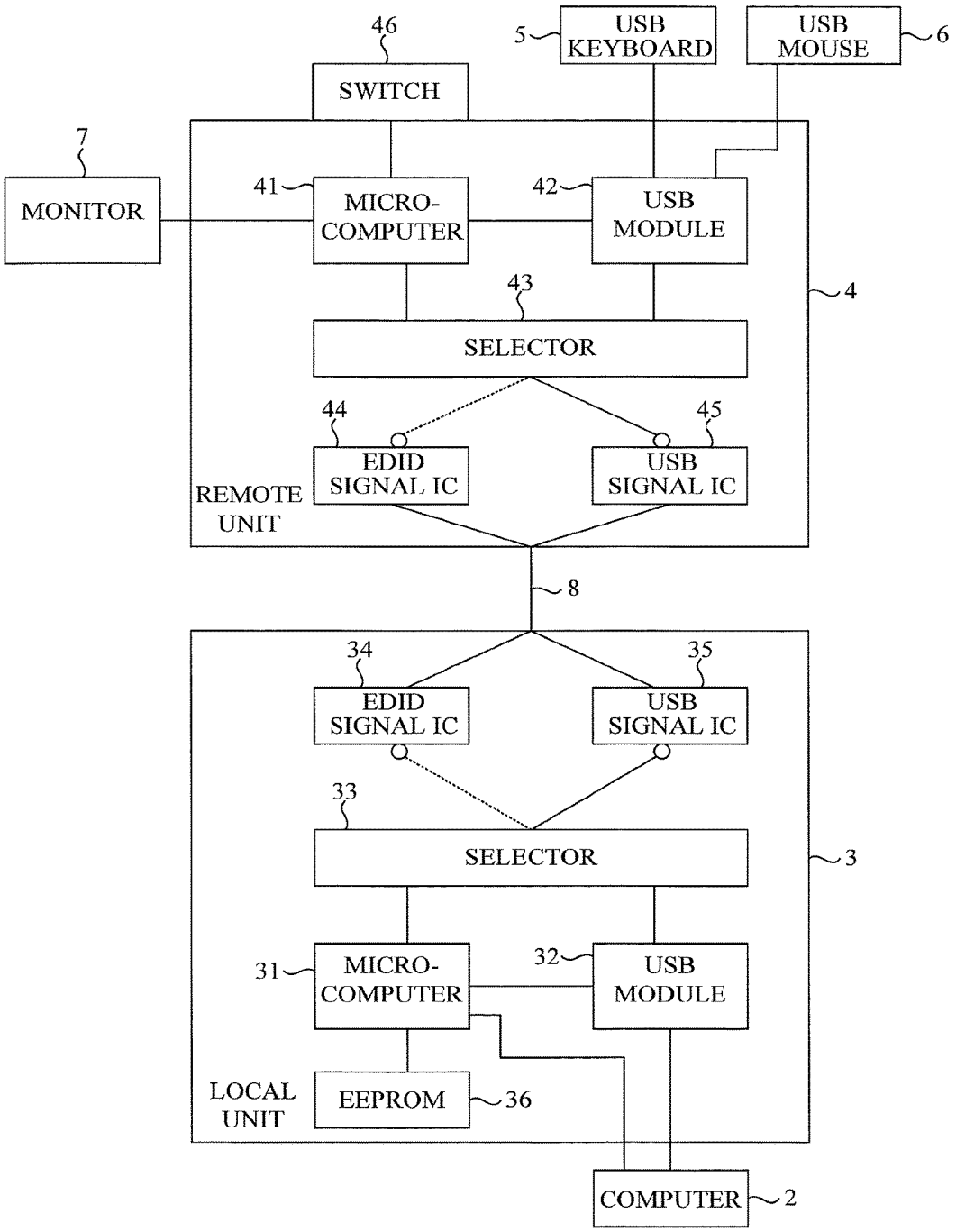
FIG. 3 is a diagram illustrating the schematic configuration of a local unit and a remote unit.

FIG. 3 is a diagram illustrating the schematic configuration of the local unit and the remote unit. Here, in FIG. 3, the configuration of the local unit 3 and the remote unit 4 relating to the video signal is omitted.

The local unit 3 includes: a microcomputer 31 that controls the operation of the whole local unit 3; a USB module 32 that transmits and receives the USB signal; a selector 33 that switches reception routes of the USB signal and the EDID signal; an EDID signal IC (Integrated Circuit) 34 that restores the EDID signal converted into the differential signal to an original EDID signal; a USB signal IC 35 that restores the USB signal converted into the differential signal to an original USB signal; and an EEPROM (Electrically Erasable Programmable Read-Only Memory) 36 that stores the EDID signal as EDID data. The microcomputer 31 is connected to the USB module 32, the selector 33, the EEPROM 36 and the computer 2. The USB module 32 is connected to the selector 33 and the computer 2. The selector 33 switches a connection destination to any one of the EDID signal IC 34 and the USB signal IC 35. Therefore, the selector 33 is not connected to the EDID signal IC 34 and the USB signal IC 35 at the same time. The EDID signal IC 34 and the USB signal IC 35 are connected to the signal lines for serial signal in the LAN cable 8.

The remote unit 4 includes: a microcomputer 41 that controls the operation of the whole remote unit 4; a USB module 42 that transmits and receives the USB signal; a selector 43 that switches reception routes of the USB signal and the EDID signal; an EDID signal IC 44 that converts the EDID signal into the differential signal; a USB signal IC 45 that converts the USB signal into the differential signal; and a switch 46 that inputs a transmission instruction of the EDID signal to the microcomputer 41. The microcomputer 41 is connected to the USB module 42, the selector 43, the switch 46 and the monitor 7. The USB module 42 is connected to the USB keyboard 5, the USB mouse 6 and the selector 43. The selector 43 switches a connection destination to any one of the EDID signal IC 44 and the USB signal IC 45. Therefore, the selector 43 is not connected to the EDID signal IC 44 and the USB signal IC 45 at the same time. The EDID signal IC 44 and the USB signal IC 45 are connected to the signal lines for serial signal in the LAN cable 8.

When USB communication between the local unit 3 and the remote unit 4 is established, the USB module 32 and 42 output USB link information indicating that the USB communication between the local unit 3 and the remote unit 4 is established, to the microcomputers 31 and 41, respectively. The microcomputer 31 cannot control the USB signal itself, but can receive the USB link information from the USB module 32. Therefore, the microcomputer 31 can detect the disconnection of the USB communication. Similarly, the microcomputer 41 cannot control the USB signal itself, but can receive the USB link information from the USB module 42. Therefore, the microcomputer 41 can detect the disconnection of the USB communication.

In the present embodiment, the microcomputer 41 transmits the USB signal and the EDID signal via a pair of signal lines by switching transmission routes of the USB signal and the EDID signal via the selector 43. The microcomputer 31 receives the USB signal and the EDID signal via the pair of signal lines by switching reception routes of the USB signal and the EDID signal via the selector 33. Thus, the transmission routes and the reception routes of the USB signal and the EDID signal are switched, and hence the USB signal and the EDID signal cannot be simultaneously transmitted and received between the local unit 3 and the remote unit 4.

Figure 4:
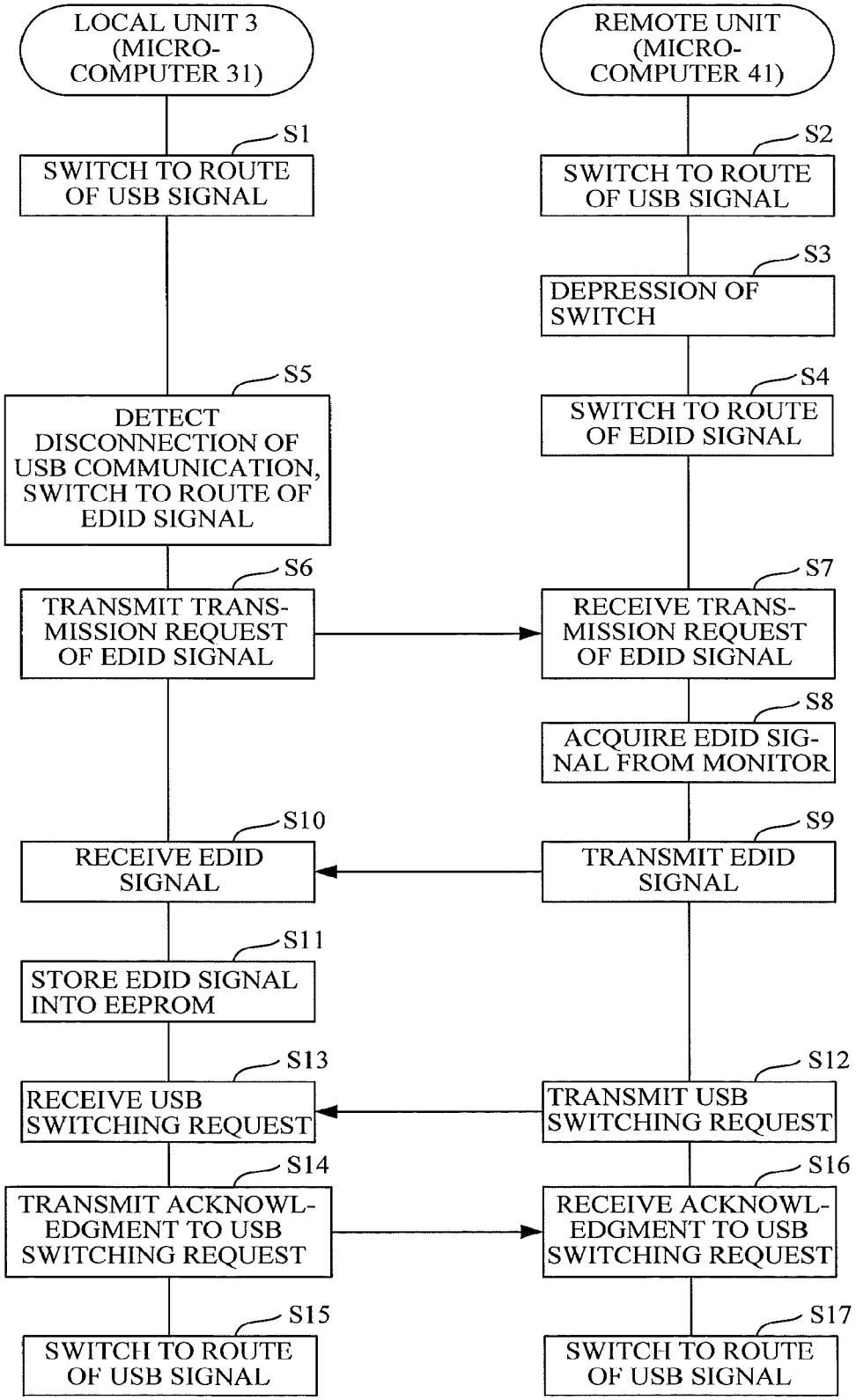
FIG. 4 is a sequence diagram illustrating processes to be executed by the local unit and the remote unit.

FIG. 4 is a sequence diagram illustrating processes to be executed by the local unit and the remote unit.

First, at the time of the power-on of the local unit 3, the microcomputer 31 controls the selector 33 to switch the connection destination of the selector 33 to the USB signal IC 35 (step S1). At the time of the power-on of the remote unit 4, the microcomputer 41 controls the selector 43 to switch the connection destination of the selector 43 to the USB signal IC 45 (step S2). In steps S1 and S2, at the time of the power-on of the local unit 3 and the remote unit 4, the microcomputers 31 and 41 control the selectors 33 and 43 so as to select signal routes of the USB signal, respectively, and make the signal routes to be selected by the local unit 3 and the remote unit 4 coincident with each other. This is because the local unit 3 and the remote unit 4 do not normally operate in a subsequent process when the signal routes to be selected by the local unit 3 and the remote unit 4 are not coincident with each other at the time of the power-on of the local unit 3 and the remote unit 4. Here, the signal routes to be selected by the local unit 3 and the remote unit 4 need to be coincident with each other at the time of the power-on of the local unit 3 and the remote unit 4. Therefore, in steps S1 and S2, at the time of the power-on of the local unit 3 and the remote unit 4, the microcomputers 31 and 41 may control the selectors 33 and 43 so as to select signal routes of the EDID signal, respectively.

When the transmission instruction of the EDID signal is inputted by depression of the switch 46 (step S3), the microcomputer 41 controls the selector 43 so as to switch the connection destination of the selector 43 to the EDID signal IC 44 (step S4). Here, when the connection destination of the selector 43 is switched to the EDID signal IC 44, the USB communication between the local unit 3 and the remote unit 4 is disconnected. Therefore, the USB link information is not inputted from the USB modules 32 and 42 to the microcomputers 31 and 41, respectively.

The microcomputer 31 detects the disconnection of the USB connection between the local unit 3 and the remote unit 4 based on non-input of the USB link information, and controls the selector 33 so as to switch the connection destination of the selector 33 to the EDID signal IC 34 (step S5). At this moment, the signal route of the USB signal in the local unit 3 and the remote unit 4 (i.e., a route passing through the USB signal ICs 35 and 45) is switched to the signal route of the EDID signal (i.e., a route passing through the EDID signal ICs 34 and 44).

The microcomputer 31 transmits a transmission request of the EDID signal to the microcomputer 41 (step S6). The microcomputer 41 receives the transmission request of the EDID signal (step S7) and acquires the EDID signal from the monitor 7 (step S8). The microcomputer 41 transmits the EDID signal acquired from the monitor 7 to the microcomputer 31 (step S9). The microcomputer 31 receives the EDID signal (step S10), and stores the EDID signal into the EEPROM 36 (step S11). The EDID signal stored into the EEPROM 36 is transmitted to the computer 2 and used for the transmission of the video signal.

Next, since the transmission of the EDID signal is completed, the microcomputer 41 transmits a USB switching request (i.e., a switching request that switches from the signal route of the EDID signal to the signal route of the USB signal) to the microcomputer 31 (step S12). The microcomputer 31 receives the USB switching request (step S13), and transmits an acknowledgment to the USB switching request (i.e., an acknowledgment indicating the reception of the USB switching request) to the microcomputer 41 (step S14). Then, the microcomputer 31 controls the selector 33 so as to switch the connection destination of the selector 33 to the USB signal IC 35 (step S15). The microcomputer 41 receives the acknowledgment to the USB switching request from the microcomputer 31 (step S16), and controls the selector 43 so as to switch the connection destination of the selector 43 to the USB signal IC 45 (step S17). By steps S15 and S17, the signal route of the EDID signal in the local unit 3 and the remote unit 4 is switched to the signal route of the USB signal.

Here, the EDID signal is used for the transmission of the video signal from the computer 2. Therefore, if the EDID signal is once transmitted to the computer 2 via the local unit 3, the EDID signal does not have to be transmitted many times from the remote unit 4. Accordingly, the signal routes in the local unit 3 and the remote unit 4 are generally set to the signal routes of the USB signal.

Hereinafter, a description will be given of a case where the switching of the signal line occurs, with reference to FIGS. 5 to 12.

Figure 5:
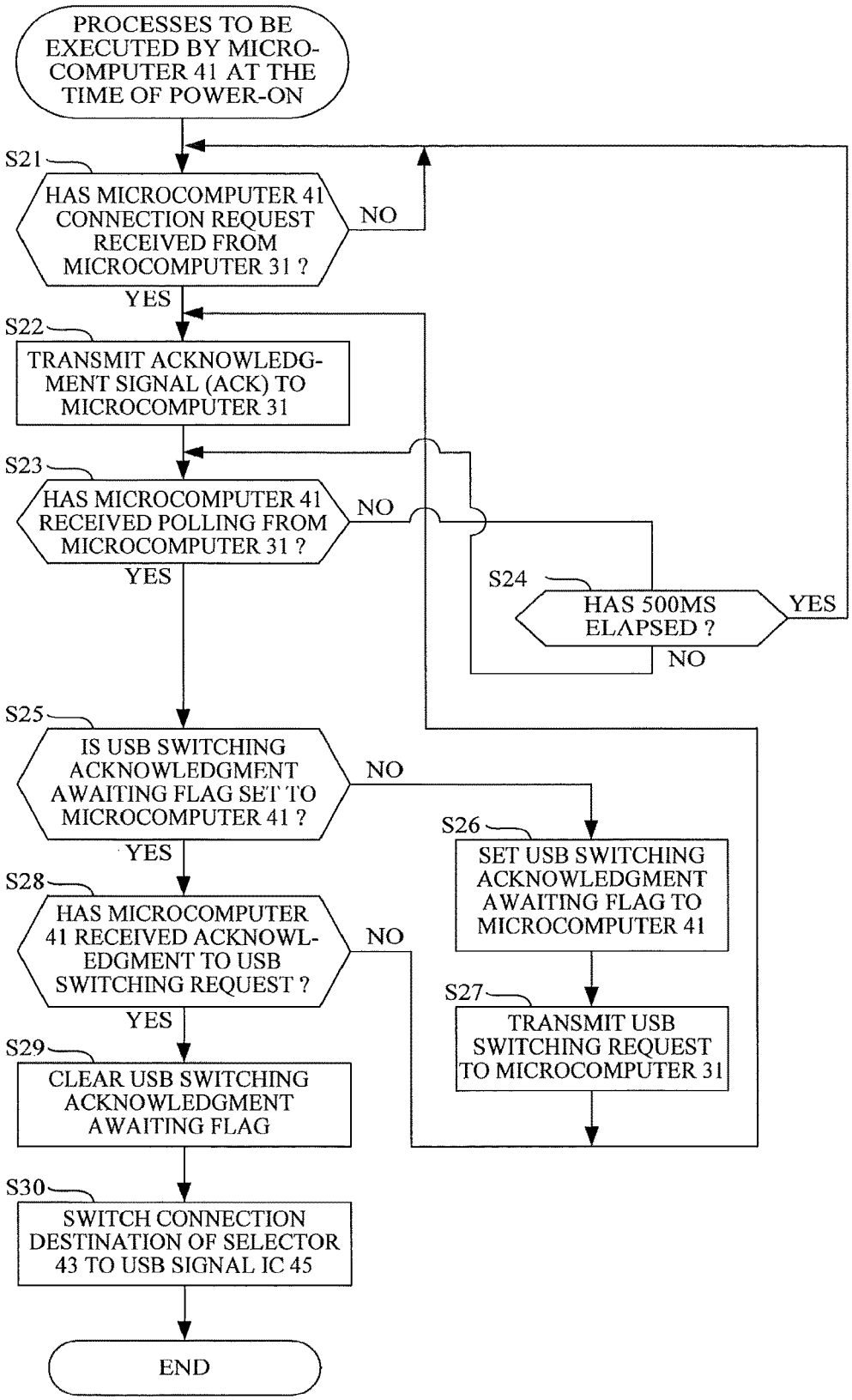
FIG. 5 is a flowchart illustrating processes to be executed by a microcomputer at the time of the power-on of the remote unit.

FIG. 5 is a flowchart illustrating processes to be executed by the microcomputer 41 at the time of the power-on of the remote unit 4. The present processes are executed in order to make the signal routes to be selected by the local unit 3 and the remote unit 4 coincident with each other at the time of the power-on of the remote unit 4.

The microcomputer 41 judges whether to have received a connection request (Connect) from the microcomputer 31 of the local unit 3 (step S21). When the microcomputer 41 has not received the connection request from the microcomputer 31 of the local unit 3 (NO in step S21), the judgment of step S21 is repeated. On the other hand, when the microcomputer 41 has received the connection request from the microcomputer 31 of the local unit 3 (YES in step S21), the microcomputer 41 transmits an acknowledgment signal (Ack) to the microcomputer 31 of the local unit 3 (step S22).

The microcomputer 41 judges whether to have received a polling from the microcomputer 31 of the local unit 3 (step S23). Here, the polling is data transmitted from the microcomputer 31 to the microcomputer 41 in order to judge a preparation status of the transmission and the reception and synchronize the processes of the microcomputers 31 and 41.

When the microcomputer 41 has not received the polling from the microcomputer 31 of the local unit 3 (NO in step S23), the microcomputer 41 judges whether 500 ms has elapsed (step S24). When 500 ms has not elapsed (NO in step S24), the procedure returns to step S23. On the other hand, when 500 ms has elapsed (YES in step S24), the procedure returns to step S21.

When the microcomputer 41 has received the polling from the microcomputer 31 of the local unit 3 (YES in step S23), the microcomputer 41 judges whether a USB switching acknowledgment awaiting flag is set to the microcomputer 41 (step S25). Here, the USB switching acknowledgment awaiting flag is a flag to be set to the microcomputer 41 in order to receive an acknowledgment to the USB switching request (i.e., the switching request that switches from the signal route of the EDID signal to the signal route of the USB signal) from the microcomputer 31.

When the USB switching acknowledgment awaiting flag is not set to the microcomputer 41 (No in step S25), the microcomputer 41 sets the USB switching acknowledgment awaiting flag to oneself (step S26), and transmits the USB switching request to the microcomputer 31 (step S27). The procedure returns to step S22.

When the USB switching acknowledgment awaiting flag is set to the microcomputer 41 (YES in step S25), the microcomputer 41 judges whether to have received an acknowledgment to the USB switching request (step S28). When the microcomputer 41 has not received the acknowledgment to the USB switching request (NO in step S28), the procedure returns to step S22. On the other hand, when the microcomputer 41 has received the acknowledgment to the USB switching request (YES in step S28), the microcomputer 41 clears the USB switching acknowledgment awaiting flag (step S29), and controls the selector 43 so as to switch the connection destination of the selector 43 to the USB signal IC 45 (step S30). Thereby, the signal route of the EDID signal in the remote unit 4 is switched to the signal route of the USB signal.

Figure 6:
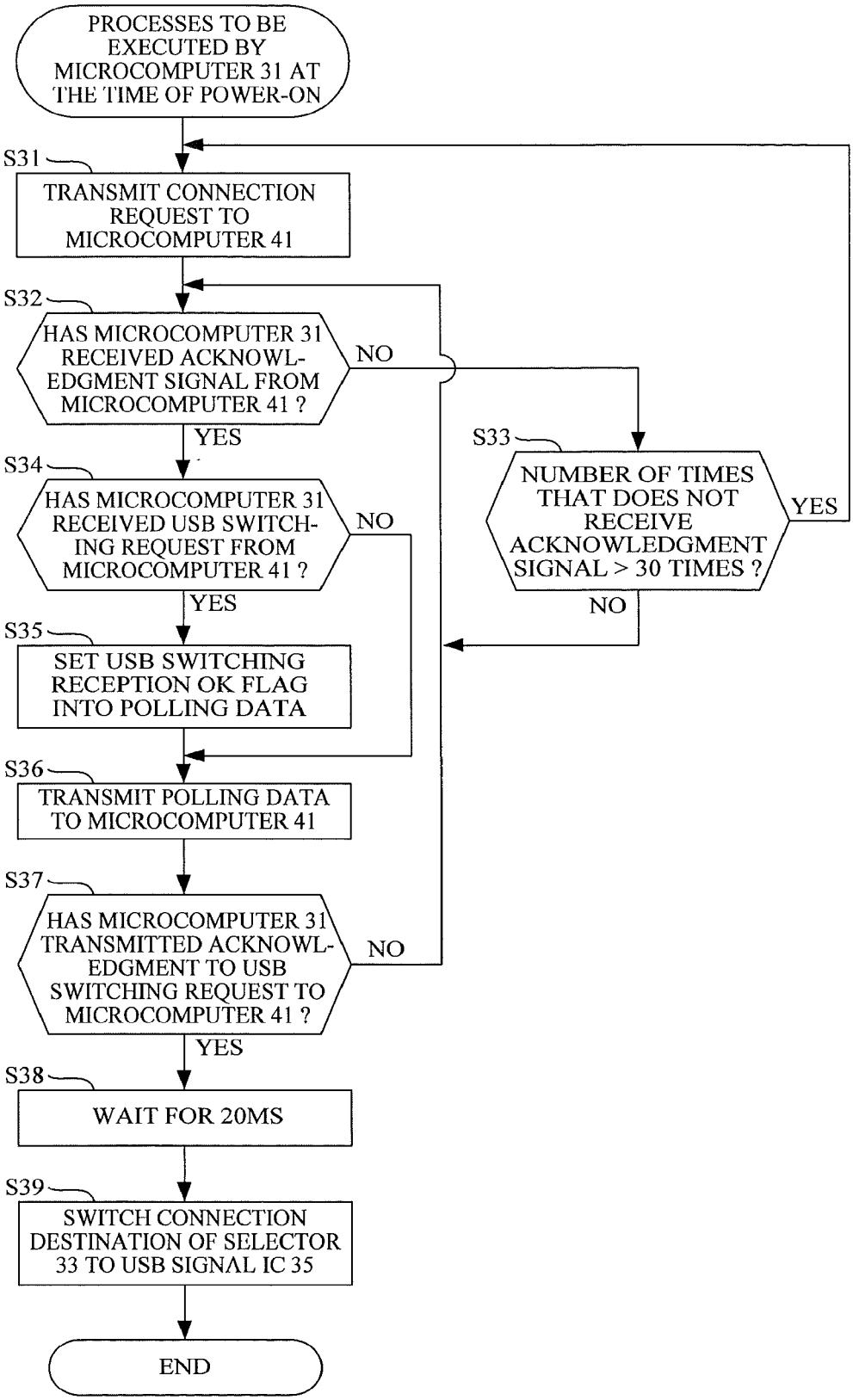
FIG. 6 is a flowchart illustrating processes to be executed by a microcomputer at the time of the power-on of the local unit.

FIG. 6 is a flowchart illustrating processes to be executed by the microcomputer 31 at the time of the power-on of the local unit 3. The present processes are executed in order to make the signal routes to be selected by the local unit 3 and the remote unit 4 coincident with each other at the time of the power-on of the local unit 3.

The microcomputer 31 transmits the connection request (Connect) to the microcomputer 41 of the remote unit 4 at intervals of 15 ms (step S31). The microcomputer 31 judges whether to have received the acknowledgment signal (Ack) from the microcomputer 41 (step S32).

When the microcomputer 31 has not received the acknowledgment signal from the microcomputer 41 (NO in step S32), the microcomputer 31 judges whether the number of times that the microcomputer 31 does not receive the acknowledgment signal (Ack) from the microcomputer 41 exceeds 30 times (step S33). When the number of times that the microcomputer 31 does not receive the acknowledgment signal (Ack) from the microcomputer 41 does not exceed 30 times (NO in step S33), the procedure returns to step S32. On the other hand, when the number of times that the microcomputer 31 does not receive the acknowledgment signal (Ack) from the microcomputer 41 exceeds 30 times (YES in step S33), the procedure returns to step S31.

When the microcomputer 31 has received the acknowledgment signal from the microcomputer 41 (YES in step S32), the microcomputer 31 judges whether to have received the USB switching request from the microcomputer 41 (step S34). When the microcomputer 31 has not received the USB switching request from the microcomputer 41 (NO in step S34), the procedure advances to step S36 as described later. On the other hand, when the microcomputer 31 has received the USB switching request from the microcomputer 41 (YES in step S34), the microcomputer 31 sets a USB switching reception OK flag into polling data to be transmitted to the microcomputer 41 (step S35). The USB switching reception OK flag is a flag to be set to the microcomputer 31 in order to indicate that the microcomputer 31 has received the USB switching request. The microcomputer 31 transmits the polling data to the microcomputer 41 at intervals of 8 ms (step S36).

Next, the microcomputer 31 judges whether to have transmit an acknowledgment (i.e., an OK acknowledgment) to the USB switching request to the microcomputer 41 (step S37). When the microcomputer 31 has not transmitted the acknowledgment to the USB switching request to the microcomputer 41 (NO in step S37), the procedure returns to step S32. On the other hand, when the microcomputer 31 has transmitted the acknowledgment to the USB switching request to the microcomputer 41 (YES in step S37), the microcomputer 31 waits for 20 ms (step S38), and controls the selector 33 so as to switch the connection destination of the selector 33 to the USB signal IC 35 (step S39). Thereby, the signal route of the EDID signal in the remote unit 4 is switched to the signal route of the USB signal.

Figure 7:
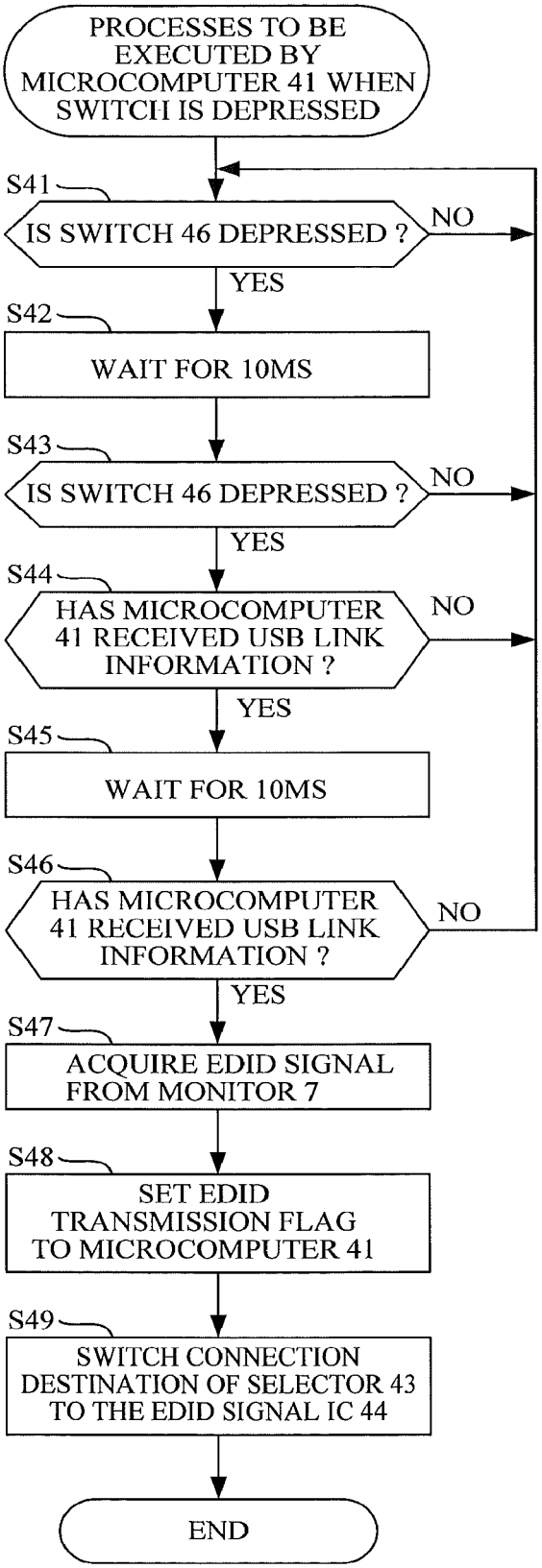
FIG. 7 is a flowchart illustrating processes to be executed by the microcomputer when a switch of the remote unit is depressed.

FIG. 7 is a flowchart illustrating processes to be executed by the microcomputer 41 when the switch 46 of the remote unit 4 is depressed.

The microcomputer 41 judges whether the switch 46 is depressed (step S41). When the switch 46 is not depressed (NO in step S41), the judgment is repeated. On the other hand, when the switch 46 is depressed (YES in step S41), the microcomputer 41 waits for 10 ms (step S42), and judges again whether the switch 46 is depressed (step S43). Steps S41 to S43 are processes that do not make the microcomputer 41 recognize that the switch 46 is ON by an unintended phenomenon (e.g. a noise and chattering).

When the switch 46 is not depressed (NO in step S43), the procedure returns to step S41. When the switch 46 is depressed (YES in step S43), the microcomputer 41 judges whether to have received the USB link information from the USB module 42 (step S44).

When the microcomputer 41 has not received the USB link information (NO in step S44), the procedure returns to step S41. When the microcomputer 41 has received the USB link information (YES in step S44), the microcomputer 41 waits for 10 ms (step S45), and judges again whether to have received the USB link information from the USB module 42 (step S46). Steps S44 to S46 are processes that do not make the microcomputer 41 recognize that the USB link information has been received by the unintended phenomenon (e.g. the noise and the chattering).

When the microcomputer 41 has not received the USB link information (NO in step S46), the procedure returns to step S41. When the microcomputer 41 has received the USB link information (YES in step S46), the microcomputer 41 acquires the EDID signal from the monitor 7 (step S47), and sets an EDID transmission flag to oneself (step S48). Here, the EDID transmission flag is a flag to be set to the microcomputer 41 in order to indicate that the microcomputer 41 transmits the EDID signal to the microcomputer 31. Then, the microcomputer 41 controls the selector 43 so as to switch the connection destination of the selector 43 to the EDID signal IC 44 (step S49). Thereby, the signal route of the USB signal in the remote unit 4 is switched to the signal route of the EDID signal.

Figure 8:
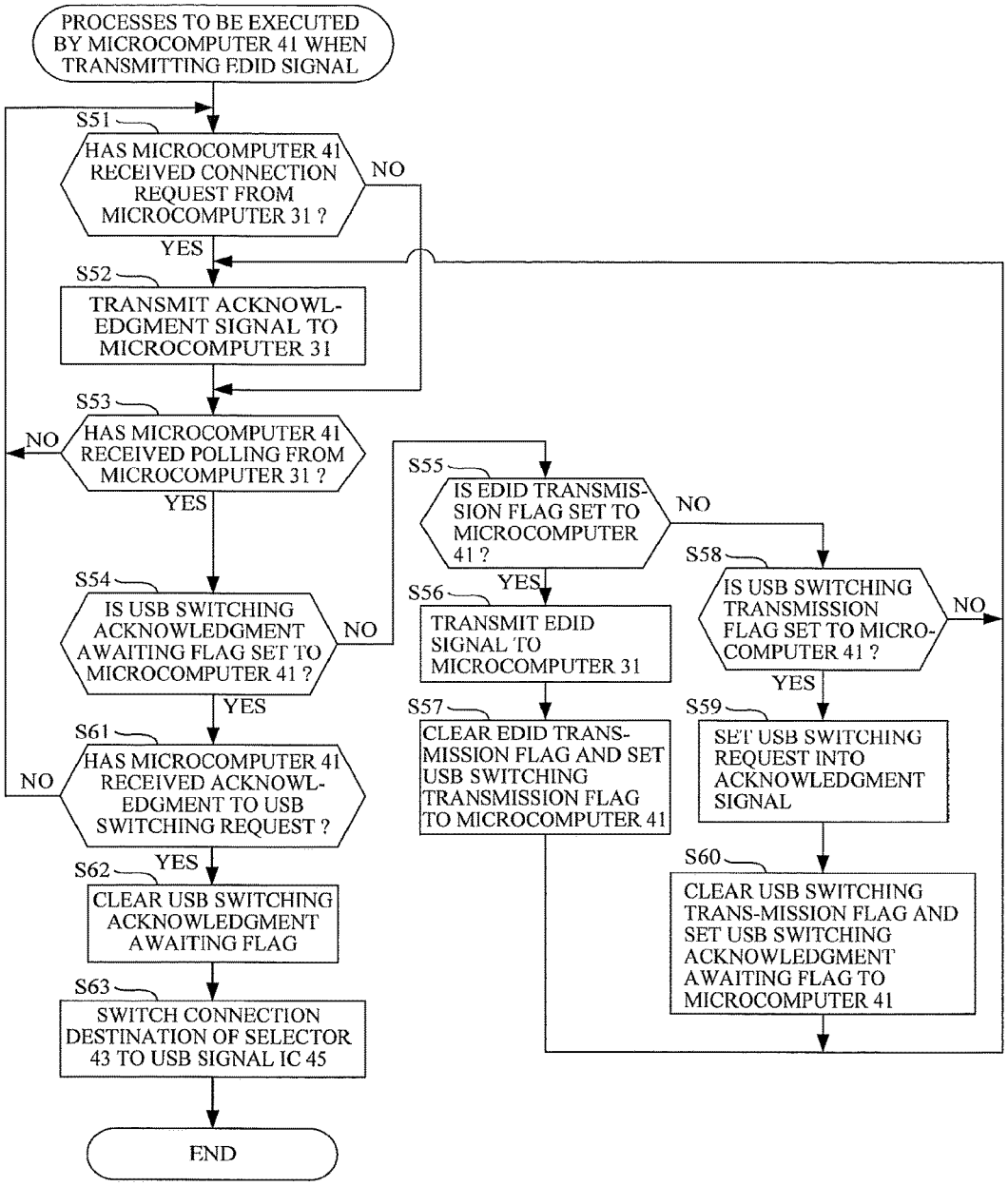
FIG. 8 is a flowchart illustrating processes to be executed by the microcomputer when the remote unit transmits an EDID signal.

FIG. 8 is a flowchart illustrating processes to be executed by the microcomputer 41 when the remote unit 4 transmits the EDID signal.

The microcomputer 41 judges whether to have received the connection request (Connect) from the microcomputer 31 of the local unit 3 (step S51). When the microcomputer 41 has not received the connection request from the microcomputer 31 of the local unit 3 (NO in step S51), the procedure advances to step S53 as described later. On the other hand, when the microcomputer 41 has received the connection request from the microcomputer 31 of the local unit 3 (YES in step S51), the microcomputer 41 transmits the acknowledgment signal (Ack) to the microcomputer 31 of the local unit 3 (step S52).

The microcomputer 41 judges whether to have received a polling from the microcomputer 31 of the local unit 3 (step S53). When the microcomputer 41 has not received the polling from the microcomputer 31 of the local unit 3 (NO in step S53), the procedure returns to step S51

When the microcomputer 41 has received the polling from the microcomputer 31 of the local unit 3 (YES in step S53), the microcomputer 41 judges whether the USB switching acknowledgment awaiting flag is set to oneself (step S54). When the USB switching acknowledgment awaiting flag is not set to the microcomputer 41 (NO in step S54), the microcomputer 41 judges whether the EDID transmission flag is set to oneself (step S55).

When the EDID transmission flag is set to the microcomputer 41 (YES in step S55), the microcomputer 41 transmits the EDID signal to the microcomputer 31 (step S56), clears the EDID transmission flag and sets a USB switching transmission flag to oneself (step S57). The procedure returns to step S52. The USB switching transmission flag is a flag to be set to the microcomputer 41 in order to indicate that the microcomputer 41 transmits the USB switching request to the microcomputer 31.

When the EDID transmission flag is not set to the microcomputer 41 (NO in step S55), the microcomputer 41 judges whether the USB switching transmission flag is set to oneself (step S58).

When the USB switching transmission flag is not set to the microcomputer 41 (NO in step S58), the procedure returns to step S52. When the USB switching transmission flag is set to the microcomputer 41 (YES in step S58), the microcomputer 41 sets the USB switching request into the acknowledgment signal (Ack) (step S59). The microcomputer 41 clears the USB switching transmission flag and sets the USB switching acknowledgment awaiting flag to oneself (step S60). The procedure returns to step S52.

When the USB switching acknowledgment awaiting flag is set to the microcomputer 41 (YES in step S54), the microcomputer 41 judges whether to have received the acknowledgment to the USB switching request (step S61). When the microcomputer 41 has not received the acknowledgment to the USB switching request (NO in step S61), the procedure returns to step S51. On the other hand, when the microcomputer 41 has received the acknowledgment to the USB switching request (YES in step S61), the microcomputer 41 clears the USB switching acknowledgment awaiting flag (step S62), and controls the selector 43 so as to switch the connection destination of the selector 43 to the USB signal IC 45 (step S63). Thereby, the signal route of the EDID signal in the remote unit 4 is switched to the signal route of the USB signal.

Figure 9:
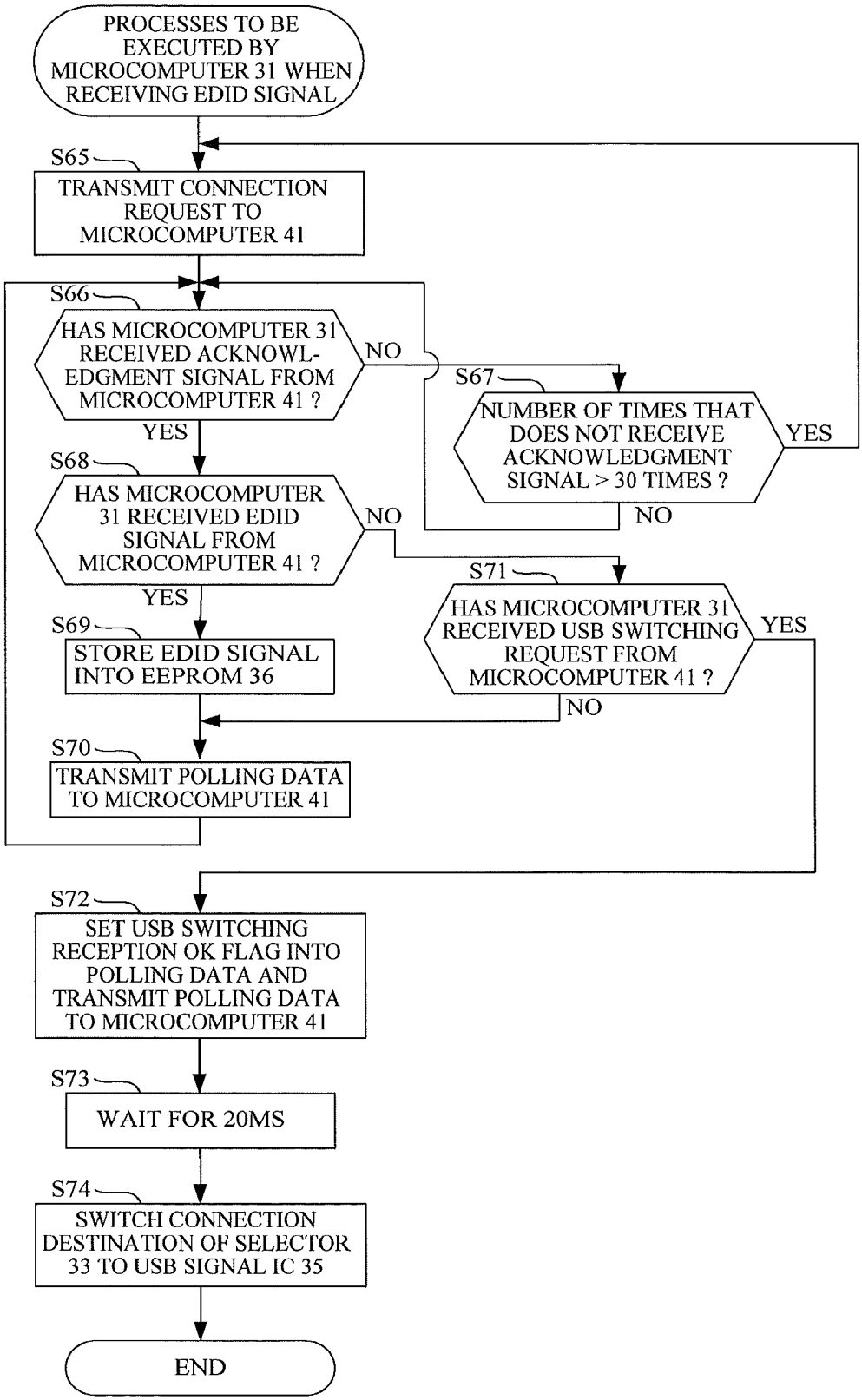
FIG. 9 is a flowchart illustrating processes to be executed by the microcomputer when the local unit receives the EDID signal.

FIG. 9 is a flowchart illustrating processes to be executed by the microcomputer 31 when the local unit 3 receives the EDID signal.

The microcomputer 31 transmits the connection request (Connect) to the microcomputer 41 of the remote unit 4 at intervals of 15 ms (step S65). The microcomputer 31 judges whether to have received the acknowledgment signal (Ack) from the microcomputer 41 (step S66).

When the microcomputer 31 has not received the acknowledgment signal (Ack) from the microcomputer 41 (NO in step S66), the microcomputer 31 judges whether the number of times that the microcomputer 31 does not receive the acknowledgment signal (Ack) from the microcomputer 41 exceeds 30 times (step S67). When the number of times that the microcomputer 31 does not receive the acknowledgment signal (Ack) from the microcomputer 41 does not exceed 30 times (NO in step S67), the procedure returns to step S66. On the other hand, when the number of times that the microcomputer 31 does not receive the acknowledgment signal (Ack) from the microcomputer 41 exceeds 30 times (YES in step S67), the procedure returns to step S65.

When the microcomputer 31 has received the acknowledgment signal (Ack) from the microcomputer 41 (YES in step S66), the microcomputer 31 judges whether to have received the EDID signal from the microcomputer 41 (step S68).

When the microcomputer 31 has received the EDID signal from the microcomputer 41 (YES in step S68), the microcomputer 31 stores the EDID signal into the EEPROM 36 (step S 69). The microcomputer 31 transmits the polling data to the microcomputer 41 at intervals of 8 ms (step S70). The procedure advances to step S66.

When the microcomputer 31 has not received the EDID signal from the microcomputer 41 (NO in step S68), the microcomputer 31 judges whether to have received the USB switching request from the microcomputer 41 (step S71). When the microcomputer 31 has not received the USB switching request from the microcomputer 41 (NO in step S71), the procedure advances to step S70. When the microcomputer 31 has received the USB switching request from the microcomputer 41 (YES in step S71), the microcomputer 31 sets the USB switching reception OK flag into the polling data to be transmitted to the microcomputer 41, and transmits the polling data to the microcomputer 41 (step S72). The microcomputer 31 waits for 20 ms (step S73), and controls the selector 33 so as to switch the connection destination of the selector 33 to the USB signal IC 35 (step S74). Thereby, the signal route of the EDID signal in the local unit 3 is switched to the signal route of the USB signal.

Figure 10:
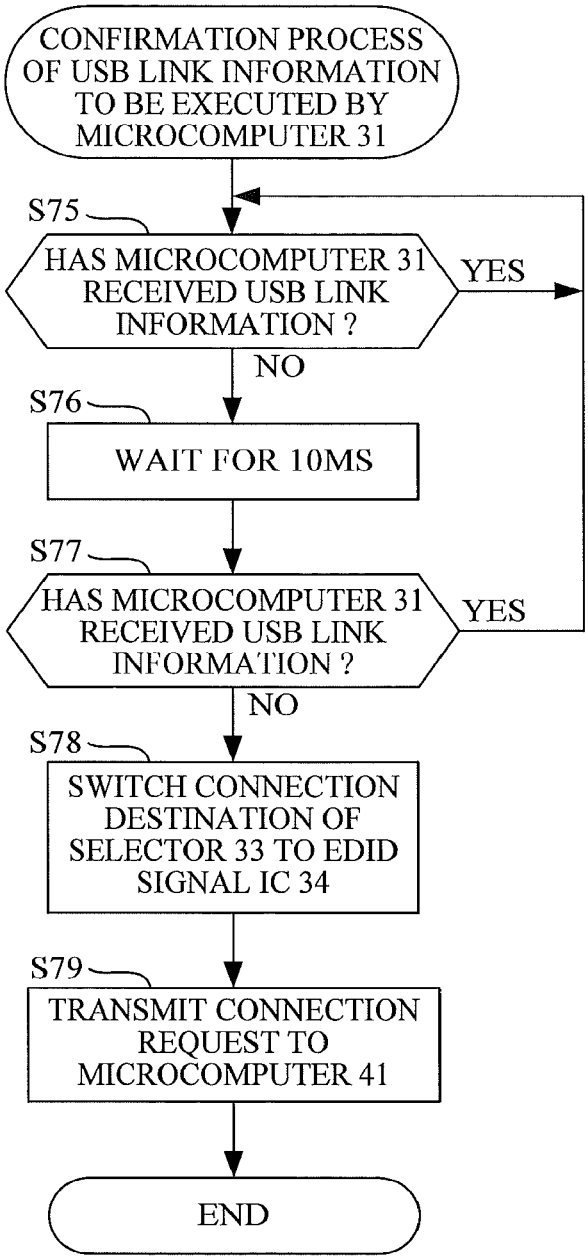
FIG. 10 is a flowchart illustrating a confirmation process of USB link information to be executed by the microcomputer of the local unit.

FIG. 10 is a flowchart illustrating a confirmation process of the USB link information to be executed by the microcomputer 31.

The microcomputer 31 judges whether to have received the USB link information from the USB module 32 (step S75). When the microcomputer 31 has received the USB link information (YES in step S75), the judgment of step S75 is repeated.

When the microcomputer 31 has not received the USB link information (NO in step S75), the microcomputer 31 waits for 10 ms (step S76), and judges again whether to have received the USB link information from the USB module 32 (step S77). Steps S75 to S77 are processes that do not make the microcomputer 31 recognize that the USB link information has not been received by the unintended phenomenon (e.g. the noise and the chattering).

When the microcomputer 31 has received the USB link information (YES in step S77), the procedure returns to step S75. When the microcomputer 31 has not received the USB link information (NO in step S77), the microcomputer 31 controls the selector 33 so as to switch the connection destination of the selector 33 to the EDID signal IC 34 (step S78). Thereby, the signal route of the USB signal in the local unit 3 is switched to the signal route of the EDID signal. Then, the microcomputer 31 transmits the connection request (Connect) to the microcomputer 41 of the remote unit 4 at intervals of 15 ms (step S79). The present process is terminated.

Figure 11:
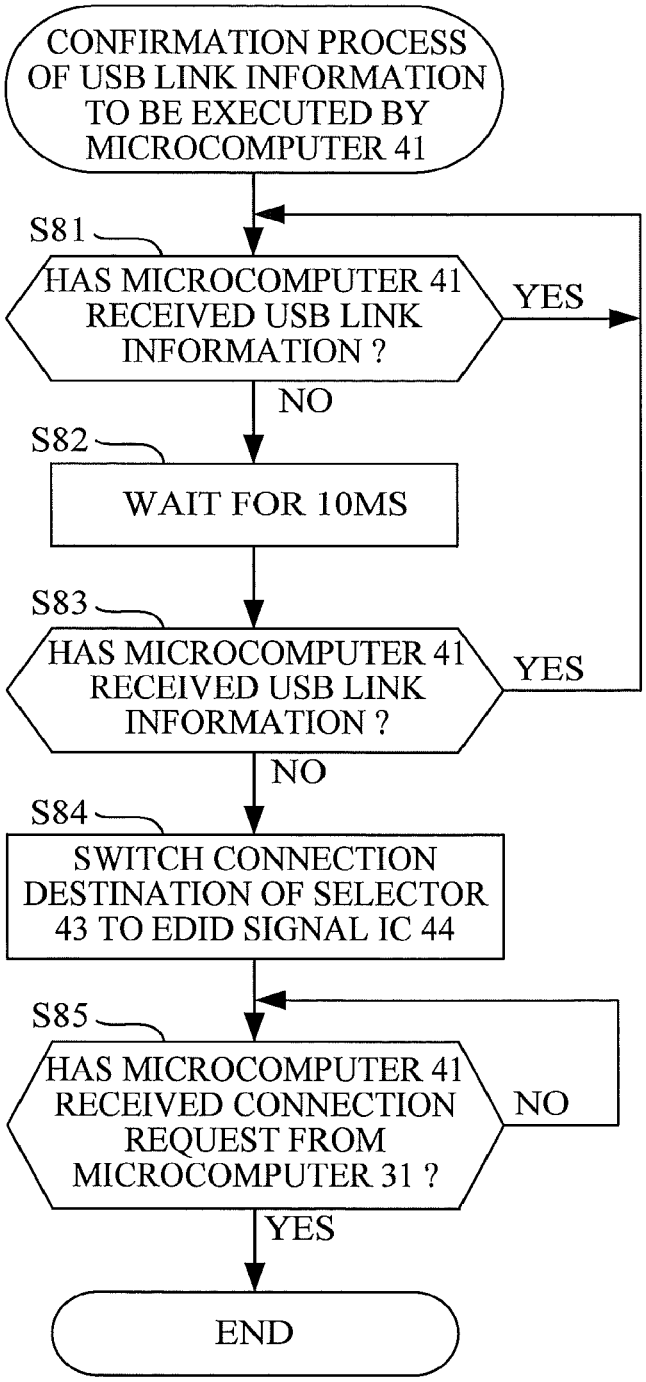
FIG. 11 is a flowchart illustrating a confirmation process of the USB link information to be executed by the microcomputer of the remote unit.

FIG. 11 is a flowchart illustrating a confirmation process of the USB link information to be executed by the microcomputer 41.

The microcomputer 41 judges whether to have received the USB link information from the USB module 42 (step S81). When the microcomputer 41 has received the USB link information (YES in step S81), the judgment of step S81 is repeated.

When the microcomputer 41 has not received the USB link information (NO in step S75), the microcomputer 41 waits for 10 ms (step S82), and judges again whether to have received the USB link information from the USB module 32 (step S83). Steps S81 to S83 are processes that do not make the microcomputer 41 recognize that the USB link information has not been received by the unintended phenomenon (e.g. the noise and the chattering).

When the microcomputer 41 has received the USB link information (YES in step S83), the procedure returns to step S81. When the microcomputer 41 has not received the USB link information (NO in step S83), the microcomputer 41 controls the selector 43 so as to switch the connection destination of the selector 43 to the EDID signal IC 44 (step S84). Thereby, the signal route of the USB signal in the remote unit 4 is switched to the signal route of the EDID signal.

Then, the microcomputer 41 judges whether to have received the connection request (Connect) from the microcomputer 31 (step S85). When the microcomputer 41 has not received the connection request from the microcomputer 31 (NO in step S85), the judgment of step S85 is repeated. When the microcomputer 41 has received the connection request from the microcomputer 31 (YES in step S85), the present process is terminated.

When the LAN cable 8 is connected to the remote unit 4 for the first time, the microcomputer 41 of the remote unit 4 executes a first connection recognition process of the LAN cable 8. However, the first connection recognition process of the LAN cable 8 is the same as the process executed by the microcomputer 41 at the time of the power-on illustrated in FIG. 5, and therefore the description of the first connection recognition process is omitted.

Figure 12:
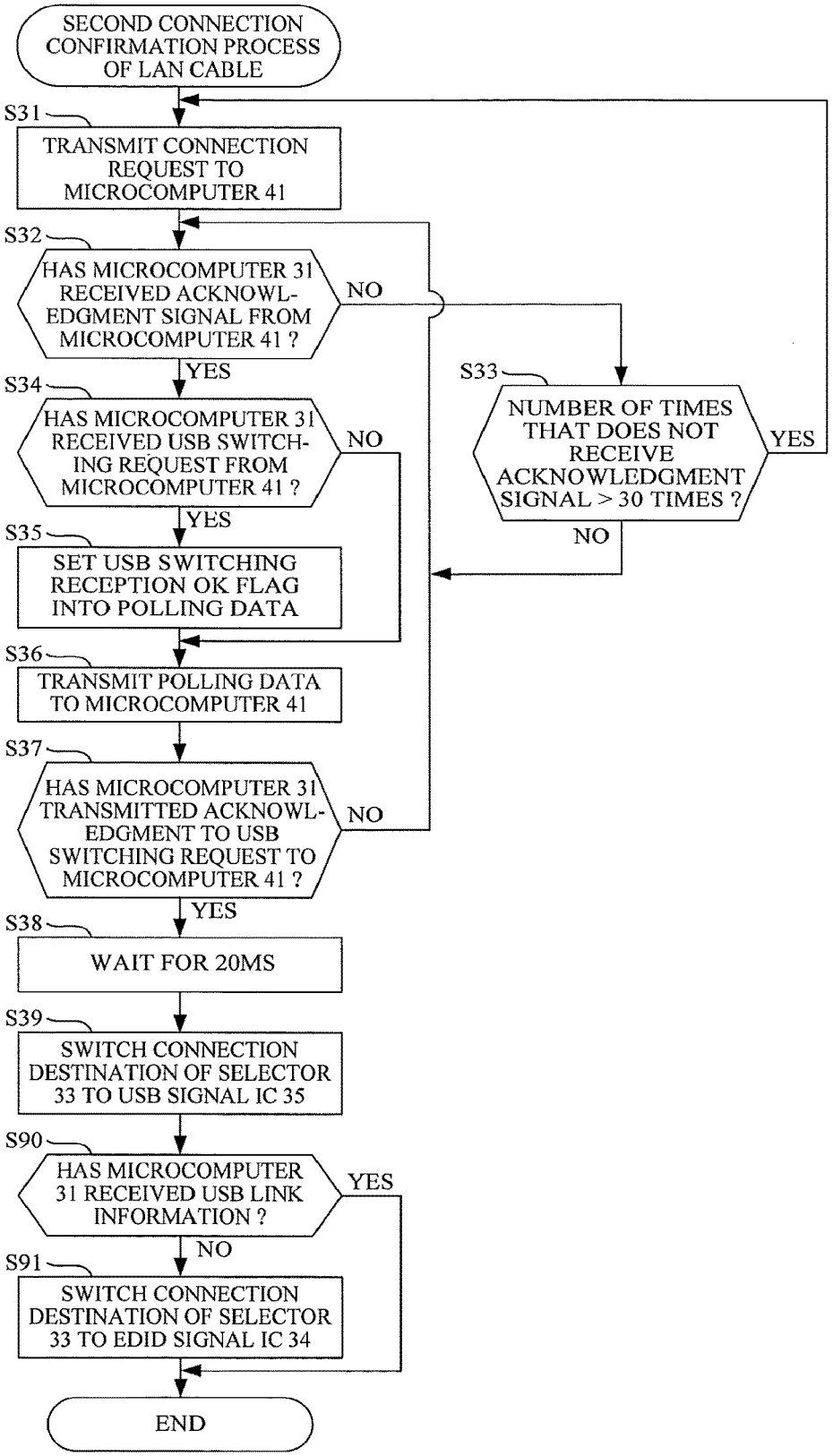
FIG. 12 is a flowchart illustrating a second connection confirmation process of the LAN cable to be executed by the microcomputer of the local unit.

When the LAN cable 8 is connected to the local unit 3 for the first time, the microcomputer 31 of the local unit 3 executes a second connection recognition process of the LAN cable 8. FIG. 12 is a flowchart illustrating the second connection confirmation process of the LAN cable 8 to be executed by the microcomputer 31. Here, the second connection recognition process of the LAN cable 8 includes the same process executed by the microcomputer 31 at the time of the power-on illustrated in FIG. 6, and therefore only a process different from the process of FIG. 6 is described.

In the second connection recognition process of the LAN cable 8 of FIG. 12, the processes of steps S 31 to S 39 of FIG. 6 are executed. Then, the microcomputer 31 judges whether to have received the USB link information from the USB module 32 (step S90). When the microcomputer 31 has received the USB link information (YES in step S90), the present process is terminated. On the other hand, when the microcomputer 31 has not received the USB link information (NO in step S90), the microcomputer 31 controls the selector 33 so as to switch the connection destination of the selector 33 to the EDID signal IC 34 (step S91). The present process is terminated. By step S91, the signal route of the USB signal in the local unit 3 is switched to the signal route of the EDID signal.

According to the present embodiment, the remote unit 4 includes: the USB module that inputs the USB signal from the USB keyboard 5 and the USB mouse 6; the microcomputer 41 that acquires the EDID signal from the monitor 7; the switch 46 that gives an instruction to output the EDID signal to the local unit 3; and the selector 43 that selectively switches a first route for outputting the EDID signal to the local unit 3 (i.e., the route passing through the EDID signal IC 44) and a second route for outputting the USB signal to the local unit 3 (i.e., the route passing through the USB signal IC 45). Then, the microcomputer 41 controls the selector 43 so as to switch from the second route to the first route in accordance with an instruction of the switch 46. Therefore, like the prior art, a problem does not occur such that a timing that superposes the EDID signal on the USB signal is deviated and the remote unit 4 cannot transmit the EDID signal to the local unit 3. That is, the remote unit 4 can transmit the EDID signal to the local unit 3 without delay.

Also, the local unit 3 includes: the USB module 32 that detects the disconnection of the USB communication with the remote unit 4; the selector 33 that selectively switches a first route for inputting the EDID signal from the remote unit 4 (i.e., the route passing through the EDID signal IC 34) and a second route for inputting the USB signal from the remote unit 4 (i.e., the route passing through the USB signal IC 35); and the microcomputer 31 that controls the selector 33 so as to switch from the second route to the first route when the USB module 32 detects the disconnection of the USB communication with the remote unit 4. Therefore, the local unit 3 does not need to retrieve the EDID signal from the superposed signal like the prior art, and can directly acquire the EDID signal from the remote unit 4.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A communication device configured to connect to another communication device via a LAN cable including a single pair of signal lines, comprising:

a Universal Serial Bus (USB) module configured to connect to a plurality of input devices external to the communication device, and to input a USB signal from any one of the plurality of input devices;

a microcontroller configured to acquire an Extended Display Identification Data (EDID) signal from a monitor;

a switch connected to the microcontroller and configured to input to the microcontroller an instruction to output the EDID signal to the another communication device; and a selector connected to the microcontroller, the USB module, a first route to output the acquired EDID signal to the another communication device, and a second route to output the inputted USB signal to the another communication device, and configured to select any one of the first route and the second route, wherein the microcontroller controls the selector so as to select the first route in accordance with the instruction from the switch, and the USB signal, the EDID signal, a request received from or transmitted to the another communication device, and an acknowledgment to the request pass through the single pair of signal lines included in the LAN cable.

2. The communication device as claimed in claim 1, wherein when a transmission request of the EDID signal is received from the another communication device, the microcontroller acquires the EDID signal from the monitor and outputs the EDID signal to the another communication device via the first route.

3. The communication device as claimed in claim 1, wherein after the EDID signal is transmitted to the another communication device, the microcontroller transmits a route switching request to the another communication device, and when the microcontroller receives an acknowledgment to the route switching request from the another communication device, the microcontroller controls the selector so as select the second route.

4. The communication device as claimed in claim 1, wherein when the another communication device selects a route for receiving the EDID signal at the time of power-on of the communication device, the microcontroller controls the selector so as to select the first route, and when the another communication device selects a route for receiving the USB signal at the time of power-on of the communication device, the microcontroller controls the selector so as to select the second route.

5. A system comprising the communication device according to claim 1, connected to the another communication device via the LAN cable.

6. A communication device configured to connect to another communication device via a LAN cable including a single pair of signal lines, comprising:

a Universal Serial Bus (USB) module configured to perform USB communication with another communication device, and output, when the USB communication is established, USB link information indicating that the USB communication is established;

a microcontroller connected to the USB module and configured to detect disconnection of the USB communication with the another communication device based on non-input of the USB link information from the USB module to the microcontroller;

a selector connected to the microcontroller, a first route to input an EDID (Extended Display Identification Data) signal from the another communication device, and a second route to input a USB signal from the another communication device, and configured to select any one of the first route and the second route; and an output interface to connect to a computer through a cable, wherein the microcontroller controls the selector so as to select the first route when the microcontroller detects the disconnection of the USB communication with the another communication device such that the EDID signal is relayed from the another communication device to the computer through the output interface, and the USB signal, the EDID signal, a request received from or transmitted to the another communication device, and an acknowledgment to the request pass through the single pair of signal lines included in the LAN cable.

7. The communication device as claimed in claim 6, wherein the microcontroller transmits a transmission request of the EDID signal to the another communication device via the first route, receives the EDID signal from the another communication device via the first route and stores the EDID signal into a storage.

8. The communication device as claimed in claim 6, wherein after the EDID signal is received, the microcontroller receives a route switching request from the another communication device, and when the microcontroller transmits an acknowledgment to the route switching request to the another communication device, the microcontroller controls the selector so as to select the second route.

9. The communication device as claimed in claim 6, wherein when the another communication device selects a route for outputting the EDID signal at the time of power-on of the communication device, the microcontroller controls the selector so as to select the first route, and when the another communication device selects a route for outputting the USB signal at the time of power-on of the communication device, the microcontroller controls the selector so as to select the second route.

10. A system comprising the communication device according to claim 6, connected to the another communication device via the LAN cable.

* * * * *